US007481134B2

(12) United States Patent
Goldstein

(10) Patent No.: US 7,481,134 B2
(45) Date of Patent: Jan. 27, 2009

(54) BOTTLE OPENER WITH INTEGRATED WRAPPER CUTTER

(75) Inventor: Jason Goldstein, Merrimack, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 0 days.

(21) Appl. No.: 11/589,504

(22) Filed: Oct. 30, 2006

(65) Prior Publication Data

US 2008/0098854 A1 May 1, 2008

(51) Int. Cl.
*B67B 7/44* (2006.01)
*B67B 7/04* (2006.01)

(52) U.S. Cl. ..... 81/3.29; 7/155

(58) Field of Classification Search ..... 81/3.09, 81/3.29, 3.37; 7/155, 156
See application file for complete search history.

(56) References Cited

U.S. PATENT DOCUMENTS

| | | | | |
|---|---|---|---|---|
| 2,886,994 | A * | 5/1959 | Hanson | 81/3.35 |
| 4,845,844 | A | 7/1989 | Allen | |
| 5,351,579 | A | 10/1994 | Metz et al. | |
| 5,367,923 | A * | 11/1994 | Fabbro | 81/3.09 |
| 5,653,023 | A | 8/1997 | Andina | |
| D404,987 | S | 2/1999 | Larimer | |
| 5,878,497 | A | 3/1999 | Seemann et al. | |
| 5,887,305 | A * | 3/1999 | Cellini | 7/155 |
| 6,101,899 | A | 8/2000 | Nikolic | |
| 6,151,992 | A | 11/2000 | Larimer | |
| 6,196,086 | B1 * | 3/2001 | Gort-Barten | 81/3.09 |
| D477,757 | S | 7/2003 | Yu | |
| 6,622,595 | B1 * | 9/2003 | Federighi | 81/3.48 |
| 6,739,215 | B2 * | 5/2004 | Lozeau et al. | 81/3.09 |
| 6,779,213 | B2 | 8/2004 | Yip | |
| 6,886,253 | B2 | 5/2005 | Chan | |
| 7,004,050 | B2 | 2/2006 | Wong | |
| 7,024,715 | B2 * | 4/2006 | Hefti et al. | 7/156 |
| D521,333 | S | 5/2006 | Yu | |
| 2004/0231465 | A1 * | 11/2004 | Yu, II | 81/3.29 |

FOREIGN PATENT DOCUMENTS

| | | | |
|---|---|---|---|
| GB | 2348638 | A * | 10/2000 |
| HK | 1054657 | A | 11/2003 |

OTHER PUBLICATIONS

OXO, Good Grips CorkPull, www.oxo.com, Apr. 7, 2006, Helen of Troy, Ltd., New York City, New York.
OXO, Good Grips Self-Pulling Corkscrew, www.oxo.com, Oct. 16, 2007, Helen of Troy, Ltd., New York City, New York.

* cited by examiner

*Primary Examiner*—David B Thomas

(57) ABSTRACT

A bottle opener has a holding body that holds the top of the container. The holding body has a support that contacts the container and a gripping member opposite the support. The gripping member moves relative to the support between a released position, in which the gripping member permits the container to be released from the device, and an engaged position, in which the gripping member causes the container to be held between the gripping member and the support. The bottle opener also has an extracting element, such as a corkscrew, operably connected to the holding body which extracts the stopper from the container. The bottle opener has an integrated cutter positioned on at least one of the support and the gripping member, the cutter being adapted to cut the wrapper.

32 Claims, 4 Drawing Sheets

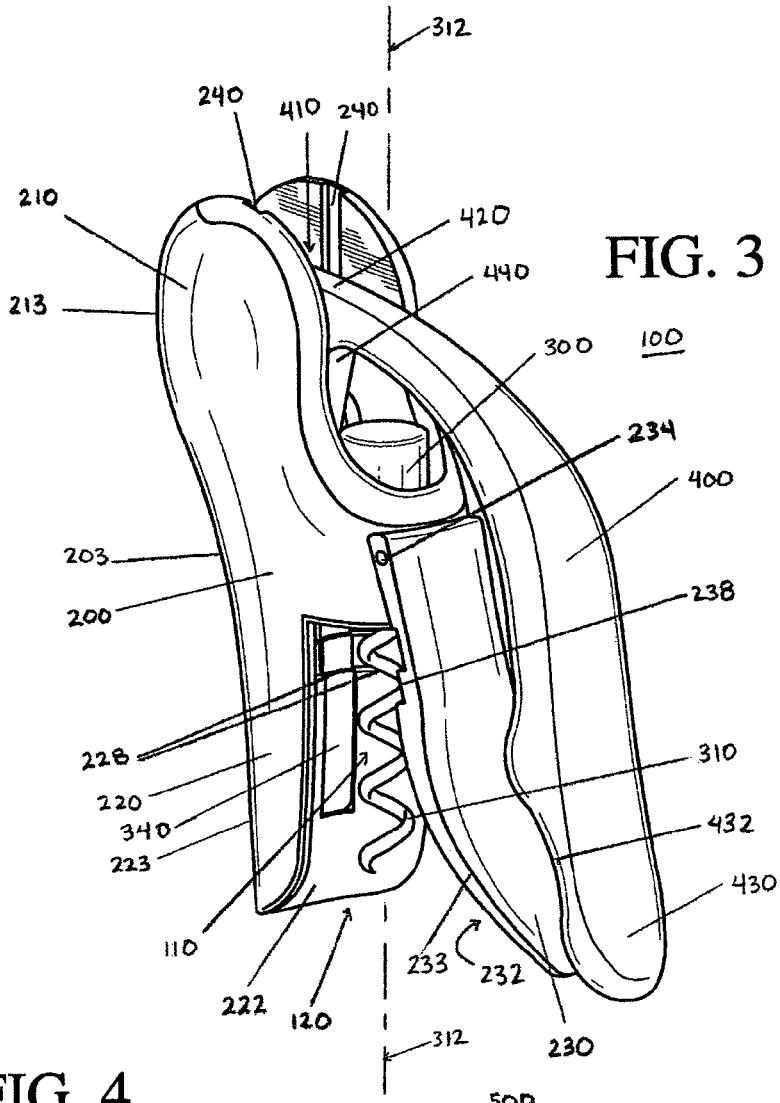
FIG. 3
FIG. 4
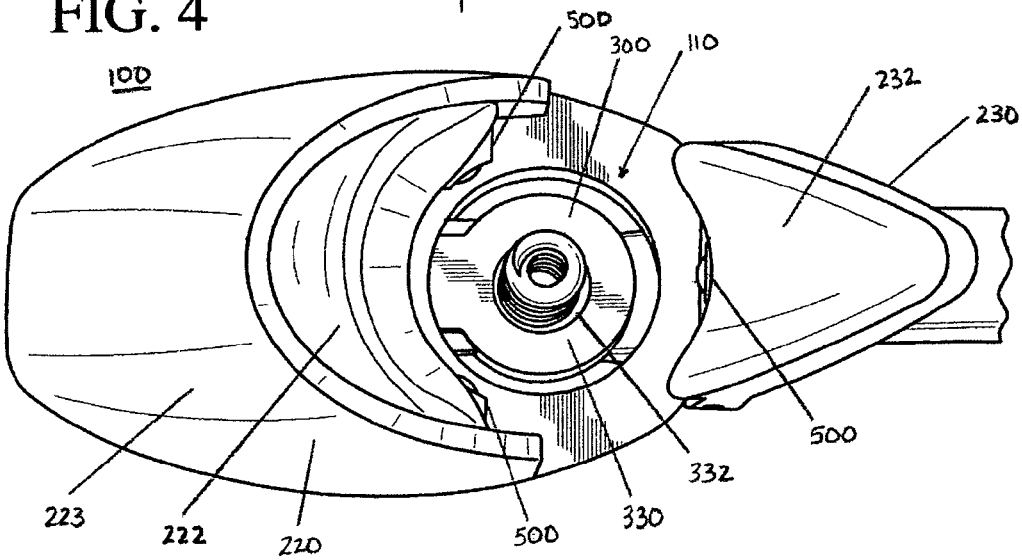

FIG. 6
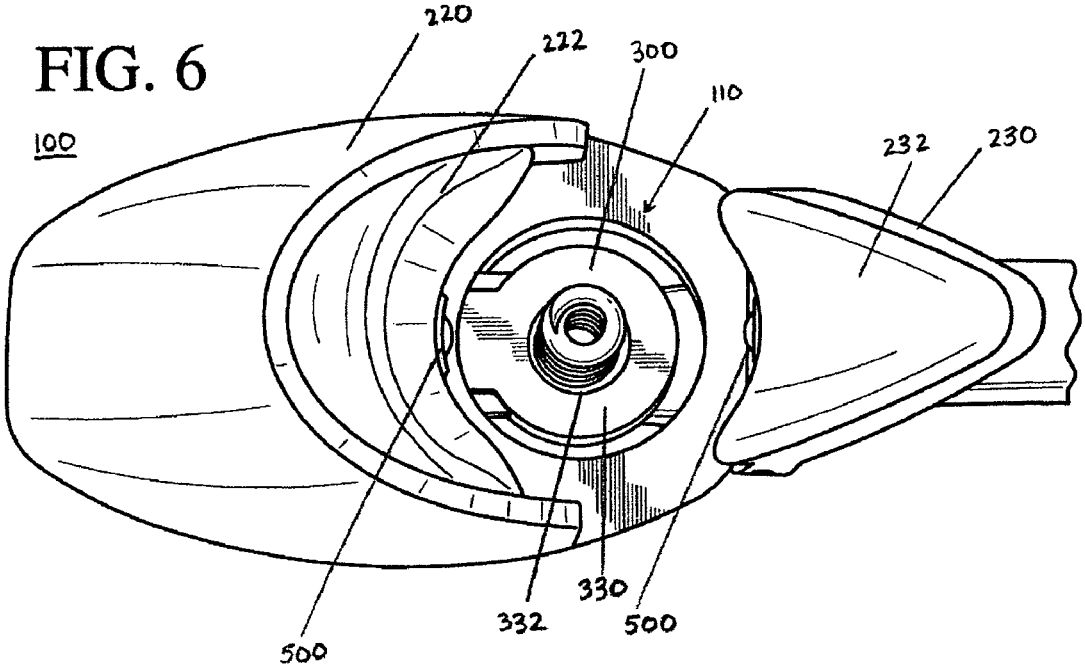
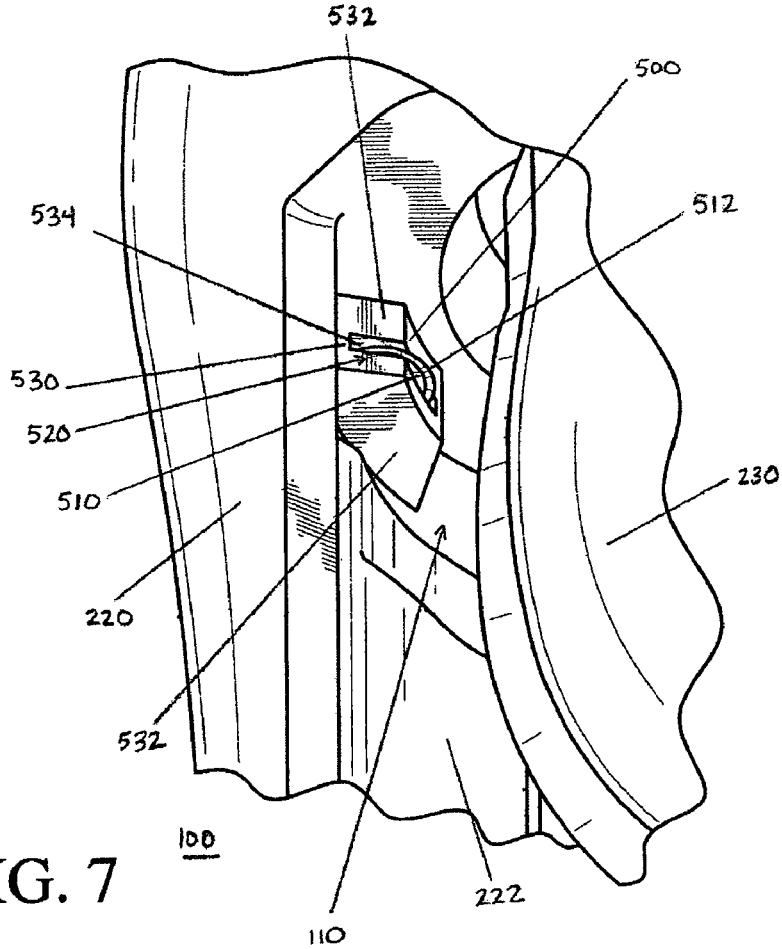
FIG. 7

BOTTLE OPENER WITH INTEGRATED WRAPPER CUTTER

BACKGROUND OF THE INVENTION

1. Field of the Invention

The present invention is directed to bottle openers, and more particularly to a bottle opener with an integrated wrapper cutter.

2. Description of Related Art

Conventional wine bottles are generally stopped or closed with a cork. A cork is positioned within the opening at the top of the wine bottle to form a tight seal with the walls of the opening. Traditional corks are made from the lightweight elastic outer bark of the cork oak, but corks may be formed from plastic, rubber, or other materials that suitably form a seal with the bottle opening when used as a stopper. Corks not only prevent the wine from escaping from the bottle, but they also protect the wine from the surrounding environment. The favorable characteristics of wine may be negatively impacted by exposure to the elements of the surrounding environment, such as air. As such, it is essential to preserve the seal created between the cork and the bottle opening.

The seal between the cork and the bottle opening itself can also be affected by the surrounding conditions. In particular, traditional corks are susceptible to drying, which can cause the seal to fail. To protect the cork from such exposure, the top of the wine bottle, with the cork positioned therein, is often covered with a wrapper. The material for the wrapper may be a metal foil or other material that is durable and helps keep the cork from drying or other damage. The wrapper also protects the top of the bottle from damage, such as chipping. In addition to its protective function, the wrapper can also be used to add aesthetic appeal to the bottle.

Because corks are often used in combination with a protective wrapper, opening a conventional wine bottle requires a two-step process. The wrapper must first be removed, and then the cork must be extracted from the bottle. In general, a knife or a tool employing a blade is used to cut the wrapper off the top of the bottle. Then, a second tool, usually equipped with a spiral-shaped corkscrew, is used to capture the cork and to pull the cork from the bottle opening. This conventional technique of opening a wine bottle has the disadvantage of requiring two separate tools, such as a pen knife and a corkscrew.

Moreover, the tools that are normally employed to apply the conventional technique above are often difficult to use. For example, in order to function properly, the wrapper around the top of the bottle is often very thick, and thus, the wrapper may be difficult to cut with a traditional pen knife. In addition, a corkscrew may be hard to manipulate. Often, the user must manually rotate the corkscrew into the cork, involving the difficult task of applying enough force to cause penetration and keeping the corkscrew properly aligned with the center of the cork. Assuming the corkscrew is properly aligned and securely positioned in the cork, the user must then exert additional force to extract the cork, which may require the awkward task of positioning the bottle to gain proper leverage. The result of these efforts is often a failure to successfully extract the cork.

While many devices have been developed to facilitate either the removal of the wrapper from the top of the bottle or the extraction of the cork, such devices still suffer from significant disadvantages. In particular, like the conventional technique described previously, these devices often require the user to exercise multiple steps with a varying range of motions.

SUMMARY OF THE INVENTION

In view of the foregoing, a need exists for a user-friendly tool that integrates functionality for removing the wrapper surrounding the top of a bottle and for extracting a cork from the bottle, while minimizing the amount of effort and motion required. Accordingly, the present invention provides a bottle opener that removes the wrapper and extracts the stopper from a container by integrating cutters with a simple-to-use extracting element.

In an exemplary embodiment, the present invention provides a bottle opener that has a holding body that holds the top of the container. The holding body has a support that contacts the container and a gripping member opposite the support. The gripping member moves relative to the support between a released position, in which the gripping member permits the container to be released from the device, and an engaged position, in which the gripping member causes the container to be held between the gripping member and the support. The bottle opener also has an extracting element operably connected to the holding body which extracts the stopper from the container. Furthermore, the bottle opener has a cutter positioned on at least one of the support and the gripping member, where the cutter is adapted to cut the wrapper.

In another exemplary embodiment, the present invention provides a bottle opener that has a receiving body. The receiving body has a wall that defines a receiving area to receive the container and that has an interior surface to support the container. The bottle opener also has an extracting element that moves between a capture position and an extracted position. The capture position corresponds with capture of the stopper, and the extracted position corresponds with removal of the stopper from the container. In addition, the bottle opener has a lever with one end extending from the receiving body and one end pivoting at the receiving body. The lever is operably connected to the extracting element and causes movement of the extracting element into the capture position and the retracted position. Furthermore, a cutter is positioned in the receiving area, where the cutter is adapted to cut the wrapper.

These and other aspects of the present invention will become more apparent from the following detailed description of the preferred embodiments of the present invention when viewed in conjunction with the accompanying drawings.

BRIEF DESCRIPTION OF THE DRAWINGS

FIG. 3 illustrates a side view of the exemplary embodiment of FIG. 1, without the conventional bottle.

FIG. 4 illustrates a view of the space between the support and the gripping member for the exemplary embodiment of FIG. 1, with the lever and the corkscrew in the capture position.

FIG. 6 illustrates an alternative configuration for the cutters.

FIG. 7 illustrates a view of an exemplary embodiment of a cutter.

DETAILED DESCRIPTION

Figure 1:
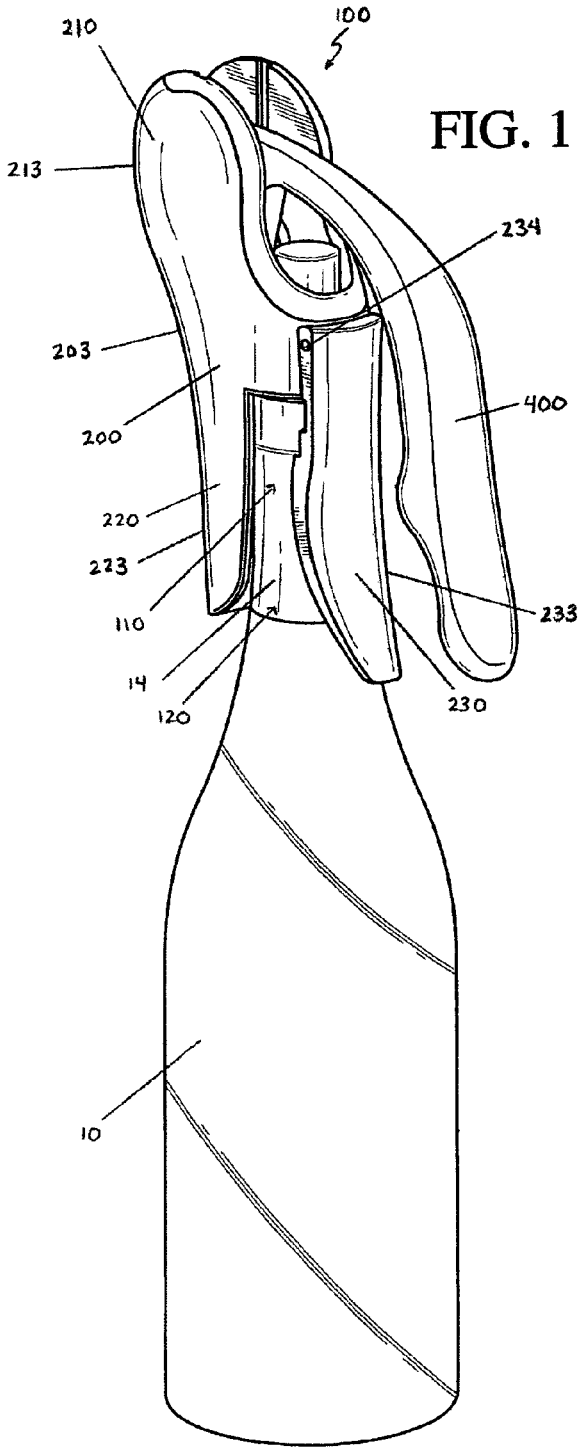
FIG. 1 illustrates a side view of an exemplary embodiment of the present invention holding a conventional bottle.

Illustrating an exemplary embodiment of the present invention, FIG. 1 shows a bottle opener 100 which can be used to remove a stopper from the opening of a bottle. In particular, the bottle opener 100 can be employed to remove a cork from a wine bottle. Although the embodiments described herein may be described with respect to opening a bottle, the present invention can generally be used to open other types of containers.

Figure 2:
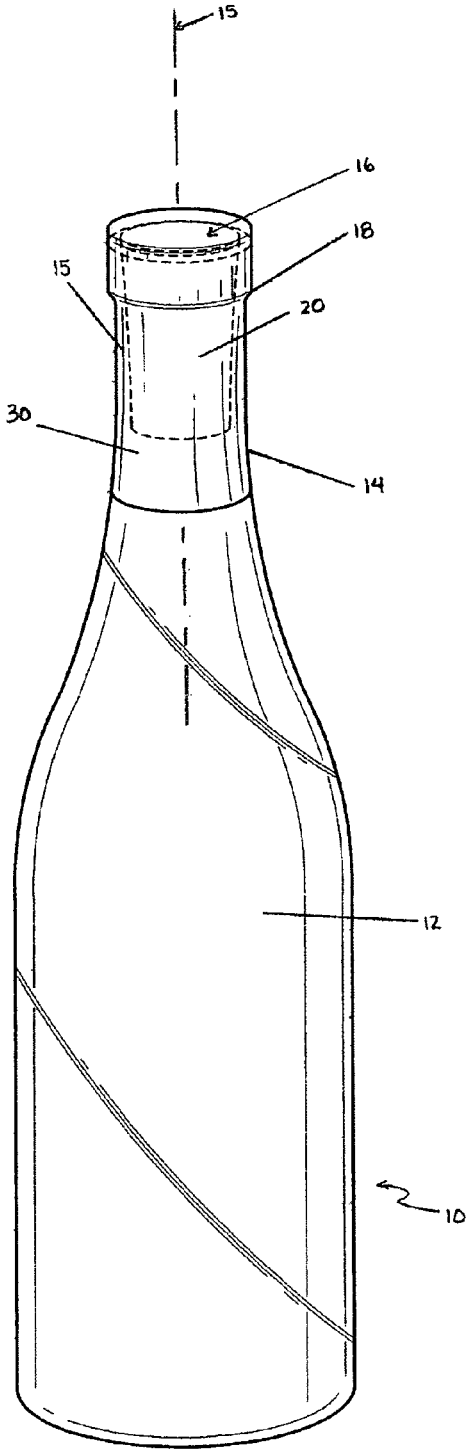
FIG. 2 illustrates a conventional bottle with wrapper and stopper.

The bottle opener 100, as shown in FIG. 1, has a holding, or receiving, body 200 which receives and holds a conventional bottle 10. FIG. 2 illustrates the details of the conventional bottle 10. The bottle 10 has an opening 16 which is closed by a stopper 20, such as a cork. The opening 16 is positioned at the top of the bottle 10. The top portion 14 of the bottle 10 may be an elongate, cylindrical neck that extends upwardly from the main body 12 of the bottle 10. The stopper 20 may have a cylindrical or frustoconical body that is positioned within, and forms a tight seal with, the cylindrical walls 15 of the top portion 14. The stopper 20 prevents the contents of the bottle 10 from escaping through the opening 16, or from being exposed to the environment outside the bottle 10. In addition, the opening 16, closed by the stopper 20, is further covered with a wrapper 30, such as foil, which protects the stopper 20 and the seal it forms with the bottle 10.

Referring again to FIG. 1, the holding body 200 has an upper body 210, a support 220, and a gripping member 230. The support 220 and the gripping member 230 extend downwardly from the upper body 210 on opposing sides. The support 220 and gripping member 230 define a space 110 therebetween, in which the bottle 10 is positioned for operation of bottle opener 100. In addition, the support 220 and the gripping member 230 define a lower opening 120 to the space 110. The lower opening 120 is opposite the upper body 210, and the bottle 10 passes through the lower opening 120 as it is received into the space 110.

Because the opening 16 of the bottle 10 is positioned at the top of the bottle 10, operation of the bottle opener 100 may only require receiving the top portion 14 of the bottle 10 into the space 110. As shown in FIG. 2, the top portion 14 may be an elongate neck which defines a longitudinal axis 15. Correspondingly, the space 10 may be elongate to accommodate the top portion 14. Furthermore, the upper body 210, the support 220, and the gripping member 230 may define a generally elongate shape for the holding body 200, which is oriented with the longitudinal axis 15.

Accordingly, when the bottle 10 is received into the space 110, the upper body 210 is positioned above the top portion 14 of the bottle 10, while the support 220 and the gripping member 230 are positioned along opposing sides of the bottle 10. As described in greater detail hereinbelow, the support 220 and gripping member 230 operate together to hold the bottle securely for operation of the bottle opener 100.

The support 220 extends downwardly from the upper body 210 to support a first side of the bottle 10. In particular, the support 220 may be an extending wall that is integrally formed with the upper body 210 as shown in FIG. 1. It is understood, however, that the upper body 210 and the support 220 may also be separately connected parts.

As shown in FIG. 3, the support 220 has an inner surface 222 to engage the first side of the bottle 10. The inner surface 222 may be shaped to accommodate the shape of the bottle 10, particularly the top portion 14. For example, the inner surface 222 may be contoured, or curved, to accommodate the cylindrical walls 15 of the top portion 14. As FIG. 3 also illustrates, the inner surface 222 may form a substantially semi-cylindrical surface to curve around half of the top portion 14. In this way, the inner surface 222 provides enough surface area to ensure sufficient contact between the support 220 and the bottle 10.

As FIG. 3 also illustrates, the gripping member 230 extends downwardly from the upper body 210 to support a second side of the bottle 10. The gripping member 230 has an inner surface 232 which engages the second side of the bottle 10. In general, the gripping member 230 opposes the support 220 so that the bottle 10 can be positioned between the gripping member 230 and the support 220. The inner surface 232 provides enough surface area to ensure sufficient contact between the gripping member 220 and the bottle 10. Furthermore, the inner surface 232 may be shaped to accommodate the shape of the bottle 10, particularly the top portion 14.

Although the support 220 may have a substantially semi-cylindrical shape as described above, the gripping member 230 is preferably shaped to leave an opening along the sides of the support 220 and the gripping member 230. This facilitates use of the bottle opener 100 by permitting the user to monitor the positioning of the bottle 10 in the space 110 and providing easy access to the space 110.

In the exemplary embodiment of FIGS. 1 and 3, the support 220 is integral with the upper body 210 and is therefore fixed with respect to the upper body 210. The gripping member 230, however, moves with respect to the upper body 210 and the support 220. In general, the gripping member 230 is moved to press against the second side of the bottle 10 and cause the bottle 10 to be pressed between the inner surface 222 of the support 220 and the inner surface 232 of the gripping member 230. This movement of the gripping member 230 reduces the space 110 between the support 220 and the gripping member 230.

As illustrated in FIG. 1, the gripping member 230 may be attached to the upper body 210 with a hinge 234, so that the gripping member 230 is able to pivot with respect to the upper body 210. In particular, the gripping member 230 is able to pivot toward the support 220 into an engaged position where the bottle 10 is held securely between inner surfaces 222 and 232. The motion of the gripping member 230, however, is not limited to the pivoting motion of this exemplary embodiment. For instance, the gripping member 230 may be fixed to the upper body 210 to move toward the support 220 in a linear motion.

To ensure secure positioning of the bottle 10 between the support 220 and the gripping member 230, both the inner surfaces 222 and 232 may be formed of a material that provides sufficient frictional contact with the bottle 10. In particular, the surface may be a textured plastic or rubber material, but is not limited to these materials.

FIG. 2 shows that the bottle 10 may have a lip 18 that runs around the opening 16. Like the opening 16, the lip 18 generally lies on a plane that is transverse to the longitudinal axis 15 defined by the elongate neck. As shown in FIG. 3, the bottle opener 100 may have opposing indentations, or ridges, 228 and 238 which extend across the surfaces 222 and 232, respectively. The indentations 228 and 238 are oriented with the lip 18 and are sized to receive the lip 18. Therefore, when the support 220 and the gripping member 230 are pressed together to engage the bottle 10, the opposing indentations 228 and 238 also engage the lip 18. The indentations 228 and 238 support the lip 18 and further prevent the bottle 10 from slipping downwardly from the area 110.

To facilitate positioning of the bottle 10 within the space 110, the inner surfaces 222 and 232 may curve outwardly, as shown in FIG. 3, to create a relatively larger lower opening 120 to receive the bottle 10. In addition, the gripping member may be biased away from the support 220 into a released position to ensure that the space 110 is as large as possible when the bottle 10 is received. For instance, a spring (not shown) may be employed to bias the gripping member 230 into the released position away from the support 220.

As shown in FIGS. 1 and 3, an outer surface 203 of the holding body 200 may be contoured, or sculpted, to accommodate operation of the bottle opener 100 by the user's hand. The outer surface 203 of the holding body 200 is defined by an outer surface 213 of the upper body 210, an outer surface 223 of the support 220, and an outer surface 233 of the gripping member 230. In particular, the outer surface 213 of the upper body 210 and the outer surface 223 of the support 220, in combination, may be contoured to fit in the palm of the user. Meanwhile, with the gripping member 230 within reach of the user's fingers, the outer surface 233 of the gripping member 230 may be contoured to accommodate the user's fingers and to allow the fingers to move the gripping member 230 toward the support 220 in a gripping motion. With the gripping member 230 in the engaged position, the holding body 200 holds the bottle 10 securely for further operation of the bottle opener 100. The holding body 200 is shaped to permit right- or left-handed use of the bottle opener 100.

In order to extract the stopper 20 from the bottle 10, the wrapper 30 which covers the stopper 20 is first removed. The present invention provides at least one cutter 500 to remove the wrapper 30. As shown in the embodiments of FIGS. 4 and 6, a plurality of cutters 500 are positioned within the space 110 between the support 220 and the gripping member 230. The holding body 200 is operated to remove the wrapper 30 with the cutters 500. In particular, the cutters 500 extend from the inner surface 222 of the support 220 and/or the inner surface 232 of the gripping member 230. When the holding body 200 is operated to press the bottle 10 between the support 220 and the gripping member 230, the cutters 500 are moved into contact with the wrapper 30. The bottle 10 and the bottle opener 100 are rotated relative to one another while the bottle 10 is positioned between the support 220 and the gripping member 230, causing the cutters 500 to rotate about the top portion 14 of the bottle 10. Holding the bottle 10 with the holding body 200, the user rotates the bottle opener 100 and/or the bottle 10 so that there is relative rotation between the bottle opener 100 and the bottle 10. With the relative rotation, the cutters 500 travel over the entire periphery of the top portion 14 to separate an upper portion of the wrapper 30 from the rest of the wrapper 30. As such, the cutters 500 may be positioned on a common plane, which may be substantially parallel to the opening 16 of the bottle 10. The upper portion of the wrapper may then be removed prior to, or with, extraction of the stopper 20. The amount of rotation required depends on the number and configuration of cutters 500 along the inner surfaces 222 and 232.

FIG. 4 shows an exemplary configuration of the cutters 500, in which two cutters 500 are positioned on the inner surface 222 of the support 220 and one cutter 500 is positioned on the inner surface 232 of the gripping member 230. In this particular configuration, the three cutters 500 lie on, or form, an imaginary circle and the arc-lengths between neighboring, or adjacent, cutters are substantially equal. With three cutters 500, neighboring cutters are spaced about 120 degrees from one another.

FIG. 6 shows yet another exemplary configuration of the cutters 500, in which one cutter is positioned on the inner surface 222 of the support 220 and one cutter is positioned on the inner surface 232 of the gripping member 230.

While the embodiments shown in FIGS. 4 and 6 employ at least one cutter 500 on the support 220 and one cutter 500 on the gripping member 230, the present invention may employ at least one cutter on only the support 220 or only the gripping member 230. To facilitate relative rotation between the bottle 10 and the bottle opener 100 while cutting the wrapper 30, especially when only one cutter 500 is used, bearings or rollers may be used on any of the surfaces to contact and guide the bottle 10.

As shown in the detailed view of FIG. 7, each cutter 500 may include a blade 510. The blade 510 extends into the space 110 to contact the wrapper 30 on the top portion 14 of the bottle 10. In addition, a biasing element 520 may be operably connected to each blade 510 to bias the blade 510 into contact with the wrapper 30. The biasing element 520 also allows the blade 510 to move back toward the inner surface of the support 220 or the gripping member 230. As such, the biasing element 520 compensates for variations in the positioning of the bottle 10, while ensuring contact with the wrapper 30. To facilitate the cutting of the wrapper 30 with rotation of the bottle 10 within the space 110, each blade 510 may have a curved edge 512 oriented substantially parallel to the top or the opening 16 of the bottle 10. It is understood, however, that the blade 510 may have various shapes. For instance, the blade 510 may be rectangular or trapezoidal. Alternatively, the cutter 500 may employ have a needle-like device which cuts the wrapper 30 by scratching a path through it.

As also shown in FIG. 7, each of the cutters 500 employs a mount 530 to hold the blade 510 and to position the blade 510 to contact the wrapper 30. The mount 530 may include two walls 532 separated by a gap 534. The blade 510 is held in the gap 534. Optionally, to facilitate relative rotation between the bottle 10 and the bottle opener 100 while cutting the wrapper 30, the blade 510 may be disc-shaped and may rotate in the gap 534.

To extract the stopper 20 from the bottle 10, the bottle opener 100 employs an extracting element 300 as shown in FIG. 3. The extracting element 300 is moved to capture the stopper 20 and allow subsequent removal of the stopper 20 from the bottle 10. In particular, the extracting element 300 includes a corkscrew 310 which has a spiral-shaped body that spirals about a longitudinal axis 312. As the corkscrew 310 penetrates the stopper 20 to capture it, the corkscrew 310 rotates about the longitudinal axis 312 which is generally oriented with the longitudinal axis 15 of the bottle 10 shown in FIG. 2. The spiral-shaped body of the corkscrew 310 screws downwardly into the stopper 20. Once the extracting element 300 fully penetrates the stopper 20, the stopper 20 is securely captured and can be removed from the bottle 10 by exerting an upward force on the stopper 20. Although the embodiments described herein may employ a corkscrew to capture the stopper, the present invention is not limited to the use of a corkscrew and may use other penetrating or capturing mechanisms.

Figure 5:
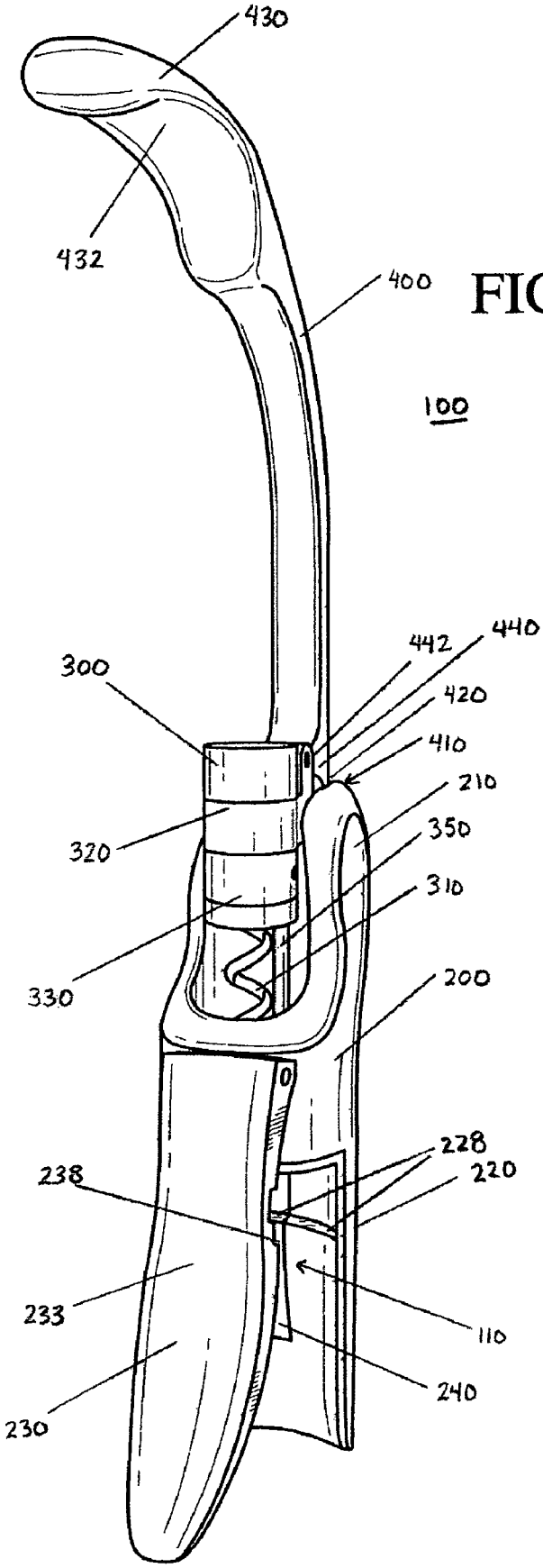
FIG. 5 illustrates a top section of the exemplary embodiment of FIG. 1, with the lever and the corkscrew in the retracted position.

Referring to FIG. 5, the extracting element 300 is operably connected to a lever 400. The lever 400 is movably connected to the holding body 200, and the lever 400 moves in relation to the holding body 200 to cause movement of the extracting element 300 relative to the holding body 200. In particular, the lever 400 moves from a capture position as shown in FIG. 3 to a retracted position as shown in FIG. 5. In the capture position, the extracting element 300 is positioned within the space 110 to permit the extracting element 300 to engage the stopper 20. In the retracted position, the extracting element 300 is positioned away from the space 110.

As shown in FIG. 5, a first end 420 of the lever 400 may be connected to the holding body 200 by a hinge mechanism 410. The hinge mechanism 410 may include any number of hinges or arms to connect the lever 400 to the holding body 200. The second end 430 of the lever 400 is operable to cause the lever 400 to pivot via the hinge mechanism 410 and to move in relation to the holding body 200. As such, the second end 430 may have a contoured handle 432 to facilitate operation of the lever 400. In general, the lever 400 may be shaped to promote ease of use, compactness, and aesthetic design.

As FIG. 5 further illustrates, the lever 400 is also movably connected to the extracting element 300. In particular, the hinge 442 connects the lever 400 to a cap 320 of the extracting element 300. The hinge 442 is positioned on an arm 440 extending from the lever 400 at a section intermediate the first end 410 and the second end 420. The cap 320 defines the top of the extracting element 300, and the corkscrew 310 extends downwardly from the cap 320. The corkscrew 310 is connected to the cap 320 in a manner that allows it to rotate freely about its longitudinal axis 312.

When the lever 400 is pivoted via the hinge mechanism 410 from the retracted position to the capture position, the arm 440 moves downwardly and also pushes the cap 320 downward. Because the cap 320 is hinged to the arm 440 by the hinge 442, the cap 320 pivots about the arm 440 when it is pushed by the arm 440. The pivoting motion permits the cap 320 to move linearly in relation to the holding body 200, even though the lever 400 and the arm 440 move rotationally relative to the holding body 200. In particular, the cap 320 may be guided along a linear track 240 positioned in the upper body 210 of the holding body 200, as shown in FIG. 3. Thus, movement of the lever 400 from the retracted position to the capture position causes the cap 320 and the corkscrew 310 to move linearly in the downward direction until the corkscrew 310 is positioned in the space 110. In other words, the corkscrew 310 correspondingly moves from a retracted position to a capture position. The hinge mechanism 410 connecting the lever 400 to the holding body 200 may require a plurality of hinges and arms in order to accommodate linear movement by the cap 320.

With the top portion 14 of the bottle 10 held in the space 110 between the gripping member 230 and the support 220, the extracting element 300 captures the stopper 20 in the bottle 10 when the lever 400 moves to the capture position and causes the corkscrew 310 to penetrate the stopper 20. While the lever 400 causes the corkscrew 310 to move linearly into the stopper 20, a guide 330 causes the spiral-shaped body of the corkscrew 310 to rotate about its longitudinal axis 312. The guide 330 is particularly illustrated in FIGS. 4 and 6. The linear downward motion and the rotational motion of the corkscrew 310 causes the corkscrew 310 to screw downwardly into the stopper 20.

The guide 330 has an aperture 332 through which the corkscrew 310 passes as it moves into the space 110. The guide 330 is positioned in a lower position just above the space 110 to guide the corkscrew 310. The aperture 332 has a fixed bar (not shown) which contacts the corkscrew 310. As the corkscrew 310 moves through the aperture 332, the bar exerts a force against the corkscrew 310 to cause it to rotate about its longitudinal axis 312. Advantageously, the length of the lever 400 from the first end 410 to the second end 420 provides enough leverage to allow the user to drive the corkscrew 310 into the stopper 20 with a small amount of force.

Once the corkscrew 310 fully penetrates the stopper 20, the stopper 20 is extracted from the bottle 10 by drawing the corkscrew 310, with the stopper 20 attached, upward by moving the lever 400 from the capture position to the retracted position. When the lever 400 pivots via the hinge mechanism 410 to the retracted position, the arm 440 moves upwardly and pulls the cap 230 and the corkscrew 310 linearly upward.

However, in order to keep the stopper 20 attached to the corkscrew 310, the corkscrew 310 does not pass back through the guide 330, as this would cause the corkscrew 310 to rotate in the reverse direction and back out of the stopper 20. Therefore, the guide 330 is drawn upward with the cap 320 and the corkscrew 310, as shown in FIG. 5, so that there is no relative motion between the guide 330 and the corkscrew 310.

Referring to FIG. 3, an extended surface 340 extends, or protrudes, from the inner surface 222 toward the gripping member 230. The extended surface 340 may be biased into this extended position by a spring (not shown). When a bottle 10 is held between the support 220 and the gripping member 230, the bottle 10 presses against the extended surface 340. The pressure moves the extended surface 340 from the extended position into a pressed position closer to the inner surface 222 of the support 220. To ensure contact with the bottle 10, the extended surface 340 may be an elongate surface oriented with the axis 312 and positioned on the middle of the inner surface 222. The extended surface 340 is connected to a latch (not shown) that engages the guide 330 when the extended surface 340 is biased in the extended position. In other words, when there is no bottle 10 being pressed between the support 220 and the gripping member 230, the latch engages the guide 330 and prevents any movement by the guide 330. On the other hand, when the bottle 10 presses the extended surface 340 into the pressed position, the latch is disengaged from the guide 330, allowing the guide 330 to move with the cap 320 and the corkscrew 310. Thus, when the corkscrew 310 captures the stopper 20, the bottle 10 remains between the support 220 and the guide 230 and presses against the extended surface 340, allowing the guide 330 to move with the corkscrew 310 as it is drawn upward to remove the stopper 20 from the bottle 10.

As FIG. 5 further illustrates, a rod 350 extends from the cap 320 to the guide 330. The rod 350 passes through a rod passageway (not shown) in the guide 330. In one aspect, the rod 350 also supports the linear movement of the cap 320. When the lever 400 causes linear motion of the cap 320, the rod 350 moves with the cap 320. When the lever 400 is in the capture position, the rod 350 passes through the rod passageway at a slight angle so that the rod 350 engages the sides of the rod passageway and grabs hold of the guide 330. If the latch is disengaged from the guide 330, the guide 330 also moves upward with the rod 350 when the cap 320 is drawn upward with the lever 400. However, if the latch is engaged with the guide, the rod 350 is unable to move the guide 330 and passes back through the rod passageway when the cap 320 is drawn upward with the lever 400.

As an added benefit, the extended surface 340 also ensures a stronger hold on the bottle 10 when the support 220 and gripping member 230 are pressed together. The extended surface 340 may also have the indentations 228 which are employed to engage the lip 18 of the bottle 10. Moreover, a cutter 500 can be positioned on the extended surface 340. Like the biasing element 520 described above, the movement of the extended surface 340 compensates for the positioning of the bottle 10. In a particular configuration of cutters, one cutter 500 may be positioned on the extended surface 340 while one cutter 500 may be positioned on the opposing inner surface 232 of the gripping member 230.

In operation, the lever 400 and the corkscrew 310 are initially in the retracted position shown in FIG. 3. The user positions the bottle 10 in the space 110 between the support 220 and the gripping member 230. The bottle 10 is positioned so that the wrapper 30 may be cut by the cutters 500. Pressing the bottle 10 between the support 220 and the gripping member 230, the one or more cutters 500 contact the wrapper 30. Holding the bottle 10 with the holding body 200, the user rotates the bottle opener 100 and/or the bottle 10 so that there is relative rotation between the bottle opener 100 and the bottle 10. The relative rotation causes the cutters 500 to move along the periphery of the bottle 10 and to cut a path through the wrapper 30. The user creates sufficient relative rotation to ensure that the cutters 500 travel along the entire periphery. In this way, the cutters 500 separate an upper portion of the wrapper 30 from the rest of the wrapper 30. The upper portion of the wrapper 30 can be removed to allow the stopper 20 to be extracted.

The user moves the lever 400 from the retracted position to the capture position shown in FIG. 3. As the lever 400 pivots via the hinge mechanism 410, the arm 440 moves the cap 320 of the extracting element 300 downward. The corkscrew 310 extending from the cap 320 moves into the space 110 and penetrates the stopper 20 in the bottle 10. The guide 330 is positioned in a lower position just above the space 110 to cause the corkscrew 310 to rotate and screw into the stopper 20. The lever 400 and the corkscrew 310 are in the captured position when the cap 320 reaches the lower position of the guide 330. This allows sufficient penetration by the corkscrew 310.

As noted previously, an upper portion of the wrapper 30 has been separated by the cutters 500. The user may remove this separated portion from the bottle 10 before operating the bottle opener 100 to extract the stopper 20. Alternatively, the stopper 20 may be extracted without first removing the separated portion. In this case, the corkscrew 310 also captures the separated portion as well as the stopper 20. The separated portion is removed along with the stopper 20.

With the stopper 20 securely captured by the corkscrew 310, the user returns the lever 400 and the corkscrew 310 to the retracted position. As the lever 400 pivots via the hinge mechanism 410 back to its initial position, the cap 320 and the corkscrew 310 move linearly upward. As the corkscrew 310 moves upward, it draws the stopper 20 out of the bottle 10. Because the bottle 10 remains pressed between the support 220 and the gripping member 230, the bottle 10 presses against the extended surface 340, causing the latch to disengage the guide 330. The rod 350 extending from the cap 320 engages the guide 330. As the rod 350 moves upward with the cap 320, the rod 350 draws the guide 330 upward as well. Thus, the corkscrew 310 does not move through the aperture 332 of the guide 330, which would otherwise cause the corkscrew 310 to screw out of the stopper 20.

Once the lever 400 and the corkscrew 310 return to the retracted position, the stopper 20 is completely removed from the bottle 10, and the bottle 10 can be removed from the bottle opener 100. With the stopper 20 attached to the corkscrew 310, the user lowers the corkscrew 310 back into the space 110 by moving the lever 400 to the capture position. The guide 330 returns to the lower position just above the area 110. Because the bottle 10 has been removed from the space 110, the extended surface 340 is no longer in the pressed position and is biased forward. Correspondingly, the latch is able to engage the guide 330. Once the guide 330 is latched, the lever 400 is moved back to the retracted position, causing linear upward movement of the cap 320 and the corkscrew 310. The guide 330 does not move with the corkscrew 310, so the stopper 20 moves upward to abut the guide 330 when the corkscrew 310 moves upward. The corkscrew 310 moves through the aperture 332 which causes the corkscrew 310 to rotate in a reverse direction and to be withdrawn from the stopper 20. In this way, the stopper 20 is removed from the corkscrew 310. Once the lever 400 reaches the retracted position again, the bottle opener 100 is ready to be used on another bottle.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A device for extracting a stopper from a top of a container, the container having a wrapper surrounding the stopper and an upper portion of the container, the device comprising:

a holding body adapted to hold the top of the container, the holding body comprising:

a support adapted to contact the container; and a gripping member opposite the support, the gripping member being movable relative to the support between a released position, in which the gripping member permits the container to be released from the device, and an engaged position, in which the gripping member causes the container to be held between the gripping member and the support;

an extracting element operably connected to the holding body, the extracting element adapted to extract the stopper from the container;

at least one cutter positioned on one of the support and the gripping member, the at least one cutter being adapted to cut the wrapper, wherein the at least one cutter comprises a blade; and a biasing element operably connected to the blade and adapted to bias the blade into contact with the wrapper.

2. The device according to claim 1, wherein the at least one cutter includes a first cutter positioned on the gripping member and a second cutter positioned on the support.

3. The device according to claim 2, wherein the at least one cutter further includes a third cutter positioned on the support.

4. The device according to claim 3, wherein the first, second, and third cutters lie on an imaginary circle and the arc-lengths between adjacent cutters on the imaginary circle are equal.

5. The device according to claim 2, wherein the first and second cutters are positioned on a common plane substantially parallel to the top of the container.

6. The device according to claim 1, wherein the support comprises an extended surface biased toward the gripping member.

7. The device according to claim 6, wherein the at least one cutter includes a first cutter positioned on the gripping member and a second cutter positioned on the extended surface.

8. The device according to claim 1, wherein the blade comprises a curved edge oriented substantially parallel to the top of the container.

9. The device according to claim 1, wherein the at least one cutter further comprises a mount adapted to hold the blade, the mount positioning the blade to contact the wrapper when the gripping member is in the engaged position.

10. The device according to claim 9, wherein the mount further comprises two walls separated by a gap, and the blade is disc-shaped and is held in the gap between the walls of the mount.

11. The device according to claim 10, wherein the disc-shaped blade is rotatable in the gap between the walls of the mount.

12. The device according to claim 1, wherein the gripping member pivots relative to the support about a hinge.

13. The device according to claim 1, wherein the gripping member is biased into the released position.

14. The device according to claim 1, wherein the support is contoured to correspond with the top portion of the container.

15. The device according to claim 1, wherein the gripping member is contoured to correspond with the top portion of the container.

16. A device for extracting a stopper from a top of a container, the container having a wrapper surrounding the stopper and an upper portion of the container, the device comprising:

a receiving body, the receiving body having a wall, the wall defining a receiving area to receive the container and having an interior surface;

an extracting element, the extracting element being movable between a capture position and an extracted position, the capture position corresponding with capture of the stopper and the extracted position corresponding with removal of the stopper from the container;

a lever pivotably connected to the receiving body and operably connected to the extracting element, the lever having an end extending from the receiving body and causing movement of the extracting element between the capture position and the retracted position;

at least one cutter positioned in the receiving area, the at least one cutter being adapted to cut the wrapper, wherein the at least one cutter comprises a blade; and a biasing device operably connected to the blade and adapted to bias the blade into contact with the wrapper.

17. The device according to claim 16, wherein the lever pivots about a hinge on the receiving body.

18. The device according to claim 16, wherein the extracting element comprises an elongate spiral member.

19. The device according to claim 18, wherein movement of the lever rotates the spiral member.

20. The device according to claim 16, wherein the at least one cutter is positioned on the interior surface of the wall.

21. The device according to the claim 16, wherein the wall further defines a side opening in the receiving area, and a gripping member is positioned along the side opening, the gripping member adapted to move relative to the receiving body.

22. The device according to claim 21, wherein the gripping member is pivotable relative to the receiving body.

23. The device according to claim 21, wherein the at least one cutter is positioned on the gripping member.

24. The device according to claim 21, wherein the at least one cutter includes a first cutter positioned on the gripping member and a second cutter positioned on the interior surface of the wall.

25. The device according to claim 24, wherein the at least one cutter further includes a third cutter positioned on the wall.

26. The device according to claim 21, wherein the gripping member is contoured to correspond with the container.

27. The device according to claim 16, wherein the blade has a curved edge oriented substantially parallel to the top of the container.

28. The device according to claim 16, wherein the blade comprises a curved edge oriented substantially parallel to the top of the container.

29. The device according to claim 16, wherein the at least one cutter further comprises a mount adapted to hold the blade, the mount positioning the blade to contact the wrapper.

30. The device according to claim 29, wherein the mount further comprises two walls separated by a gap, and wherein the blade is disc-shaped and is held in the gap between the walls of the mount.

31. The device according to claim 30, wherein the disc-shaped blade is rotatable in the gap between the walls of the mount.

32. The device according to claim 16, wherein the interior surface of the wall is contoured to correspond with the container.

* * * * *